US006494738B2

(12) United States Patent
Sawada et al.

(10) Patent No.: US 6,494,738 B2
(45) Date of Patent: Dec. 17, 2002

(54) ELECTRIC-WIRE HOLDING STRUCTURE

(75) Inventors: Yoshitsugu Sawada, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/833,685

(22) Filed: Apr. 13, 2001

(65) Prior Publication Data

US 2002/0031939 A1 Mar. 14, 2002

(30) Foreign Application Priority Data

Apr. 14, 2000 (JP) ..... 2000-113953

(51) Int. Cl.[7] ..... H01R 13/58
(52) U.S. Cl. ..... 439/456; 439/460
(58) Field of Search ..... 439/456, 457, 439/458, 459, 460, 76.1, 76.2, 942, 392, 463

(56) References Cited

U.S. PATENT DOCUMENTS 4,029,896 A * 6/1977 Skinner ..... 174/138 F
4,224,465 A * 9/1980 Ruzic ..... 174/135
5,030,136 A * 7/1991 Reinhardt et al. ..... 439/460
6,193,543 B1 * 2/2001 Howard et al. ..... 439/459
6,280,235 B1 * 8/2001 Radliff ..... 439/467

FOREIGN PATENT DOCUMENTS

JP 2-295074 12/1990

* cited by examiner

*Primary Examiner*—Tho D. Ta
*Assistant Examiner*—Ross Gushi
(74) *Attorney, Agent, or Firm*—Sughrue Mion, PLLC

(57) ABSTRACT

An electric-wire holding structure includes a wire accommodating slot for linearly wiring a covered wire, and a pair of first wire clamping pieces and a pair of second wire claming pieces, each of which are disposed at the wire accommodating slot and are opposed each other with respect to the wire accommodating slot for holing the covered wire. A center line between the pair of first wire clamping pieces is offset in one direction from a center line between the pair of second wire clamping pieces. A shortest interval connecting an inner end corner of the first wire clamping piece and an inner end corner of the second wire clamping piece is set to be equal to an opposing interval between the pair of first wire clamping pieces and an opposing interval between the pair of second wire clamping pieces.

3 Claims, 9 Drawing Sheets

ELECTRIC-WIRE HOLDING STRUCTURE

BACKGROUND OF THE INVENTION

1. Technical Field of the Invention

The present invention relates to an electric-wire holding structure which is formed in a wiring board for forming predetermined circuits inside a connector housing or an electrical connection box used in the electrical connection of a wire harness in a vehicle such as an automobile, and more particularly to an electric-wire holding structure having wire clamping portions capable of speedily and reliably clamping various electric wires of different wire diameters.

2. Related Art

In a vehicle such as an automobile in which various electronic apparatuses are mounted, a large number of connectors are used for electrical connection between the respective electronic apparatuses or between each wire harness and the electronic apparatuses. As a related connector, one disclosed in, for example, JP-A-2-295074 or the like is known. As shown in FIGS. 8 and 9, a connector 10 is known in which an electric wire 1 having a covering 2 is inserted and fitted in a plate-like housing 11 in which a wire accommodating slot 12, a wire cutting blade 13, a pair of covering cutting-in blade 14, and a pair of wire clamping pieces 16, which are linearly arranged in order, are integrally molded.

With the above-described connector 10, with the exception of the metallic wire cutting blade 13 which is insert-molded for cutting an end portion of the wire 1, the pair of covering cutting-in blades 14 made of a metal are formed by bending as single pieces separately from the plate-like housing 11. The covering cutting-in blades 14 are provided with the so-called function of an insulation displacement terminal, and are adapted to cut the covering 2 of the wire 1, which is press-fitted between the opposing portions of a substantially U-shaped gap portion, by their edge portions, and are thereby brought into contact with a core so as to obtain a conducting state.

In addition, the flexural rigidity of the wire clamping pieces 16 toward the covering cutting-in blades 14 is weakened by a pair of vertical slots 15 each provided between the wire clamping piece 16 and the covering cutting-in blade 14, a pair of undercut portions 18 provided so as to separate the wire clamping portions 16 from a bottom 12*a* of the wire accommodating slot, and a pair of chamfered portions 19 for forming an inverse V-shaped opposing gap 17. When the wire 1 is press-fitted in the opposing gap 17, the wire clamping pieces 16 are resiliently displaced toward the covering cutting-in blades 14 while displacing the covering 2 and clamping the outer surface of the covering.

In addition, the displacement of the wire clamping pieces 16 in an opposite direction to the direction toward the covering cutting-in blades 14 is suppressed, thereby preventing the wire 1 from coming off in its axial direction. Further, the coming off of the wire 1 in the upward direction is prevented by the inverse V-shaped opposing gap 17 between the pair of wire clamping pieces 16.

However, the above-described related connector 10 has a drawback in that the force with which the wire 1 is clamped is likely to deteriorate with a decline in the flexural rigidity of the wire clamping pieces 16 in the plate-like housing 11 due to the vertical slots 15, the undercut portions 18, and the chamfered portions 19.

In addition, because the wire 1 is clamped by one pair of wire clamping pieces 16, in a case where the wire diameters are of various types, it is impossible to cope with the various wire diameters since the opposing gap 17 between the wire clamping pieces 16 is fixed. Hence, there has been a problem in that exclusive-use plate-housings 11 are required for the respective kinds of wires.

SUMMARY OF THE INVENTION

The invention is aimed at overcoming the above-described problems of the conventional art, and its object is to provide an electric-wire holding structure which is capable of speedily and reliably clamping electric wires having various diameters over a relatively wide range.

In accordance with the invention, the above-described problems can be solved by an electric-wire holding structure including:

a wire accommodating slot for linearly wiring a covered wire; and a pair of first wire clamping pieces and a pair of second wire claming pieces, each of which are disposed at the wire accommodating slot and are opposed each other with respect to the wire accommodating slot for holing the covered wire;

wherein a center line between the pair of first wire clamping pieces is offset in one direction from a center line between the pair of second wire clamping pieces, and wherein a shortest interval connecting an inner end corner of the first wire clamping piece and an inner end corner of the second wire clamping piece is set to be equal to an opposing interval between the pair of first wire clamping pieces and an opposing interval between the pair of second wire clamping pieces.

In addition, preferably, to solve the above-described problems, wire clamping portions respectively including the pair of first wire clamping portion and the pair of second clamping portion are separately provided at the wire accommodating slot as a large-size wire clamping portion for large-size wire and as a small-size wire clamping portion for a small-size wire in correspondence with outside diameter of the covered wire.

Further, preferably, the electric-wire holding structure according to claim 1 further comprises an insulation displacement terminal for press-fitting the covered wire provided at the wire accommodating slot.

Further, preferably, opposing end faces of the pair of first wire cramping pieces are substantially parallel each other.

In accordance with the above-described electric-wire holding structure, the opposing interval between the pair of first wire clamping pieces in the wire accommodating slot and the opposing interval between the pair of second wire clamping pieces located adjacent to the pair of first wire clamping pieces are set to be equal, and the center line between the pair of second wire clamping pieces is offset in one direction from the center line between the pair of second wire clamping pieces. In addition, the shortest interval connecting an inner end corner of the first wire clamping piece and an inner end corner of the second wire clamping piece is set to be equal to the opposing interval between the pair of first wire clamping pieces and the opposing interval between the pair of second wire clamping pieces.

Accordingly, as the wire is inserted between the pairs of first and second wire clamping pieces, the wire can be held by the inner end corner of the first wire clamping piece and the inner end corner of the second wire clamping piece as well. Hence, the wire can be clamped in a meandering state at three positions between the pair of first wire clamping pieces, between the pair of second wire clamping pieces, and between the inner end corners of the first and second wire clamping pieces. Accordingly, electric wires having various wires diameters over a relatively wide range can be held speedily and reliably, and it is possible to reliably prevent the wire from coming off in the axial and upward directions.

In addition, in the above-described electric-wire holding structure, since the pair of large-size wire clamping portions and the pair of small-size wire clamping portions are provided in the same wire accommodating slot in correspondence with outside diameters of the covered wires, it is possible to apply the electric-wire holding structure to electric wires having at least two kinds of wire diameter, and an appropriate meandering state can be formed inside either wire clamping portions depending on the wire diameter. Accordingly, the electric wires of various diameters can be clamped more reliably between the wire clamping pieces.

DESCRIPTION OF PREFERRED EMBODIMENT

Figure 1:
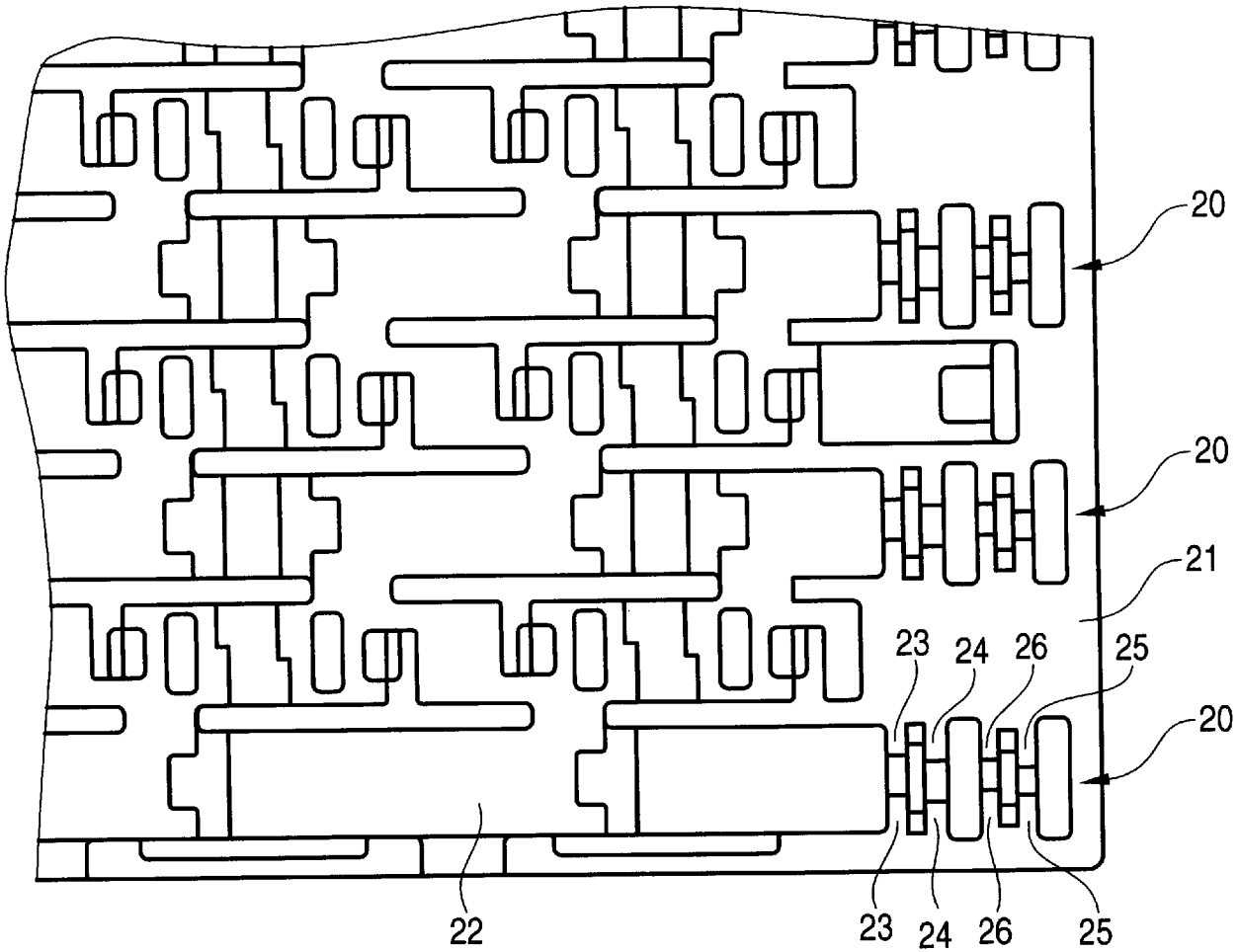
FIG. 1 is a partial plan view illustrating a corner portion of a wiring board illustrating a first embodiment of an electric-wire holding structure in accordance with the invention.
Figure 2:
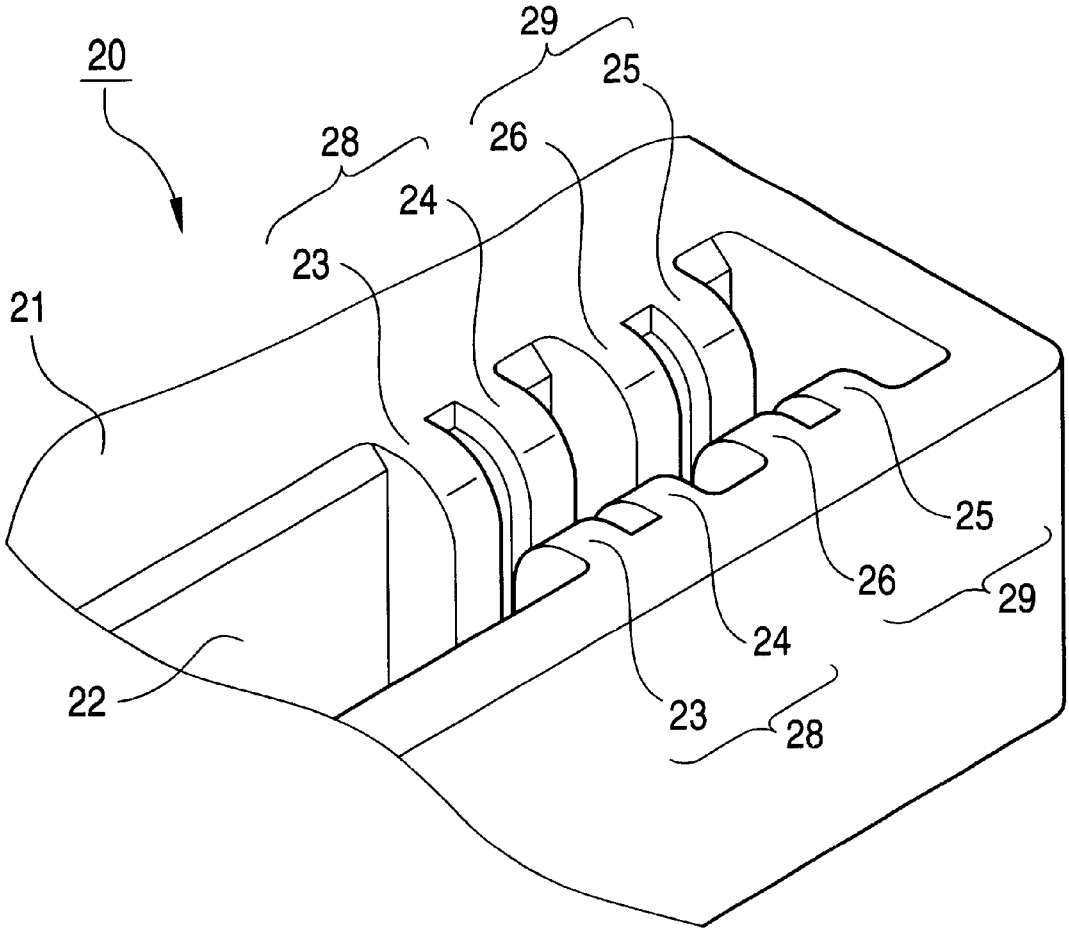
FIG. 2 is a partial perspective view illustrating an essential portion of the electric-wire holding structure shown in FIG. 1.
Figure 3:
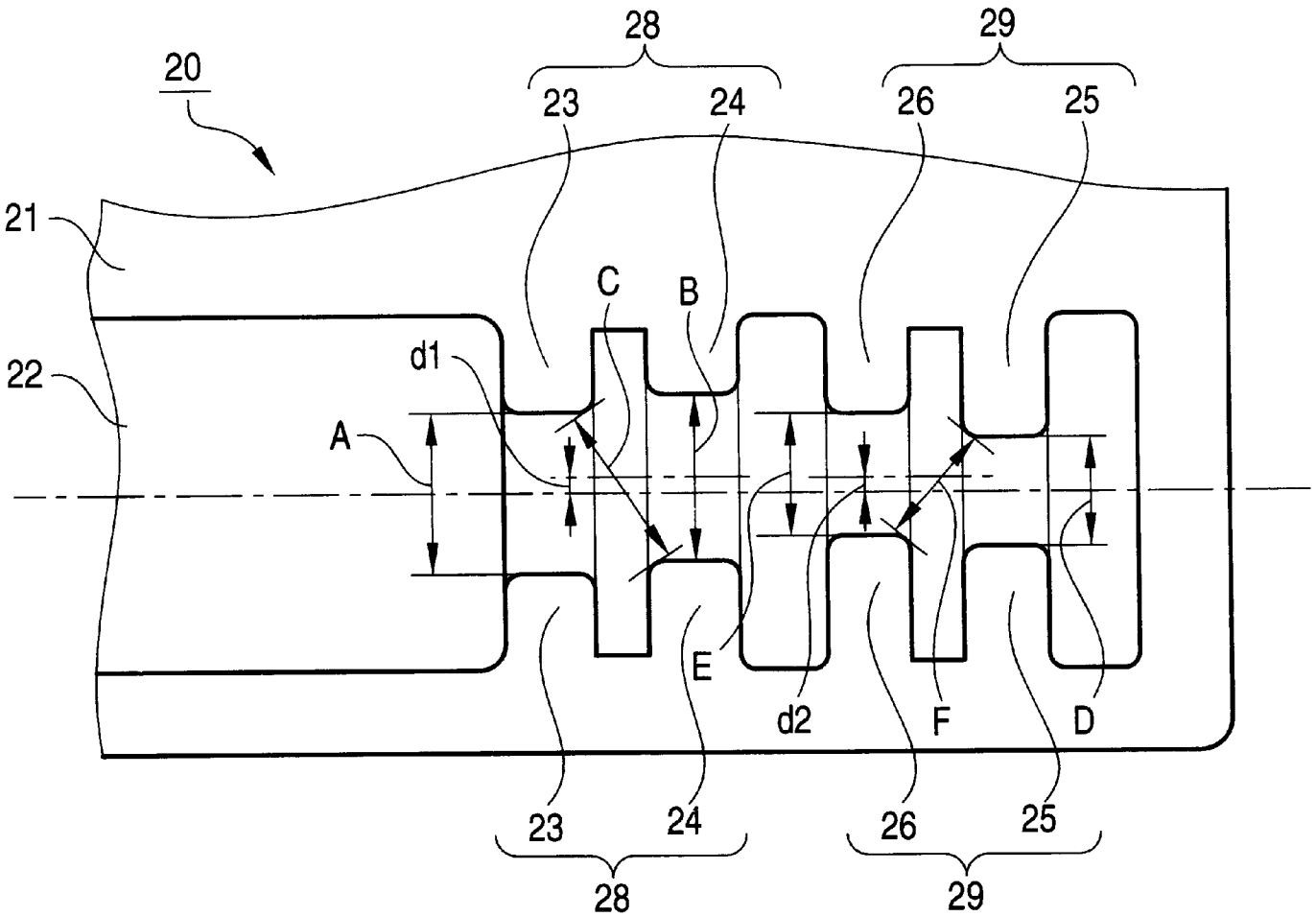
FIG. 3 is a plan view shown in FIG. 2.
Figure 4:
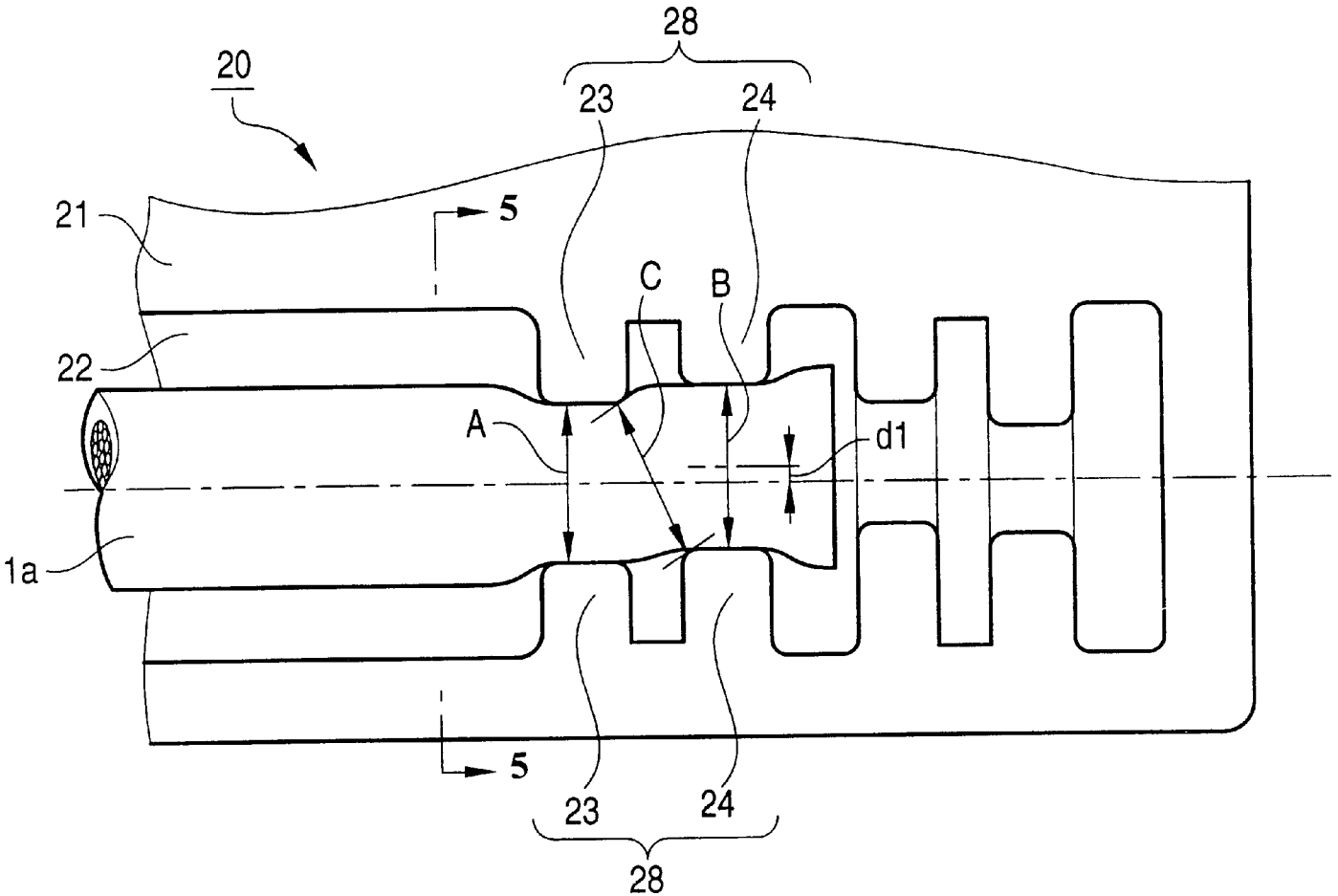
FIG. 4 is a plan view illustrating a state in which a large-size wire is held in FIG. 3.
Figure 5:
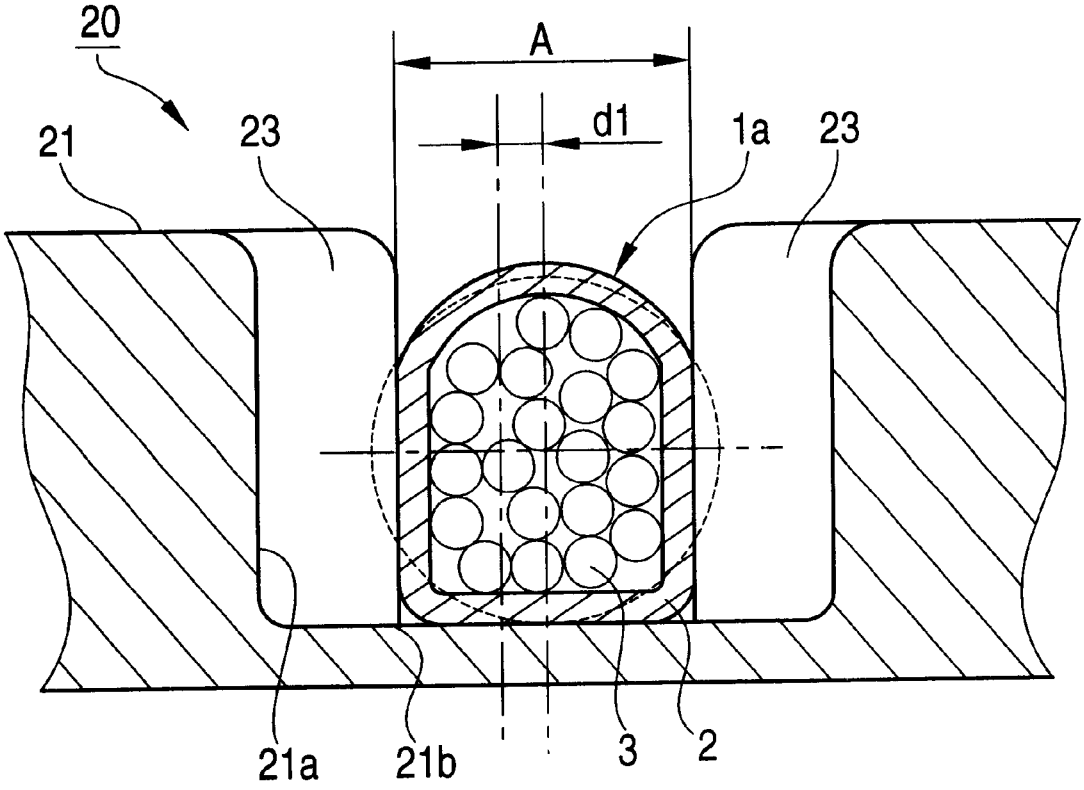
FIG. 5 is a cross-sectional view taken along line 5—5 in FIG. 4.
Figure 6:
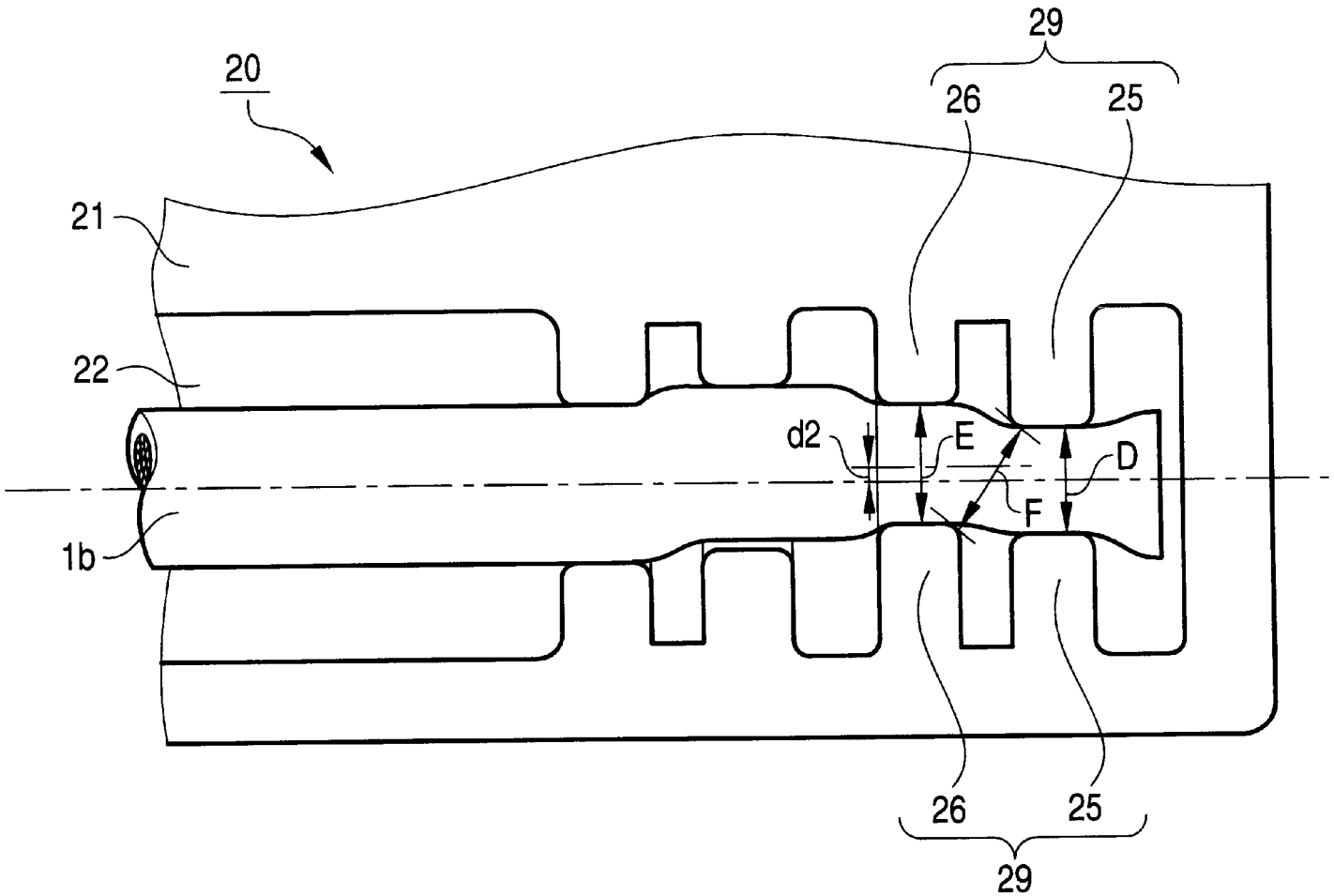
FIG. 6 is a plan view illustrating a state in which a small-size wire is held in FIG. 3.

Referring now to FIGS. 1 to 5, a detailed description will be given of a first embodiment of an electric-wire holding structure in accordance with the present invention. FIG. 1 is a partial plan view illustrating a corner portion of a wiring board having the electric-wire holding structure in accordance with the first embodiment. FIG. 2 is a partial perspective view illustrating an essential portion of the electric-wire holding structure shown in FIG. 1. FIG. 3 is a plan view shown in FIG. 2. FIG. 4 is a plan view illustrating a state in which a large-size wire is held in FIG. 3. FIG. 5 is a cross-sectional view taken along line G—G in FIG. 4. FIG. 6 is a plan view illustrating a state in which a small-size wire is held in FIG. 3.

As shown in FIG. 1, an electric-wire holding structure in this embodiment is formed on a wiring board 21 made of a resin. In this embodiment, a description will be given of the electric-wire holding structure which is formed at a corner portion of the wiring board 21 so as to hold an end portion of the electric wire.

As shown in FIG. 2, the electric-wire holding structure 20 comprises a plurality of wire accommodating slots 22 which are juxtaposed linearly in the wiring board 21 and in which covered wires are fitted, and a plurality of pairs of wire clamping pieces 23 to 26. Specifically, a large-size wire clamping portion 28, which is formed by the pair of first wire clamping pieces 23 and the pair of second wire clamping pieces 24, are integrally molded in each wire accommodating slot 22. The pair of first wire clamping pieces 23 and the pair of second wire clamping pieces 24 for a large-size wire are resin blades witch respectively oppose each other and are arranged in that order from the left-hand side in the drawing.

A small-size wire clamping portions 29, which is formed by the pair of first wire clamping pieces 25 and the pair of second wire clamping pieces 26, is similarly juxtaposed at a position adjacent to the aforementioned large-size wire clamping portions 28 in the wire accommodating slot 22. The pair of first wire clamping pieces 25 and the pair of the second wire clamping pieces 26 for a small-size wire are arranged in that order from the right-hand side in the drawing. It should be noted that an unillustrated metallic insulation displacement terminal is fitted at a predetermined position in the wire accommodating slot 22.

As shown in FIG. 3, the pair of the first wire clamping pieces 23 are provided symmetrically about the center line of the wire accommodating slot 22. Namely, the pair of the first wire clamping pieces 23 are provided such that the center line of a relatively wide opposing interval (hereafter referred to as the slot width) A between the pair of first wire clamping pieces 23 and the center line of the wire accommodating slot 22 are aligned with each other.

In contrast, a slot width B between the pair of second wire clamping pieces 24 for a large-size wire is the same as the slot width A between the pair of the first wire clamping pieces 23, but the center line of the slot width B is offset toward one side (upwardly in the drawing) by a dimension d1 from the center line between the first wire clamping pieces 23.

In addition, the shortest interval (hereafter referred to as a diagonal slot width) C connecting an inner end corner of the first wire clamping piece 23 and an inner end corner of the second wire clamping piece 24 is set to the same dimension as the slot width A between the first wire clamping pieces 23 and the slot width B between the second wire clamping pieces 24. It should be noted that the slot widths A and B and the diagonal slot width C are set to be smaller than the diameter of the large-size wire to be clamped.

Accordingly, as shown in FIG. 4, an end portion of a large-size wire 1*a*, which is linearly inserted and fitted in such a manner as to extend from the pair of first wire clamping pieces 23 to the pair of second wire clamping pieces 24, is clamped at three positions in total involving the slot width A between the first wire clamping pieces 23, the slot width B between the second wire clamping pieces 24 with the center-axis offset d1 with respect to the center line between the first wire clamping pieces 23, and the diagonal slot width C between the inner end corners of the first and second wire clamping pieces 23 and 24. Therefore, the end portion of the large-size wire 1*a* meanders by undergoing compressive deformation from the initial state of the diameter of the large-size wire. Hence, by virtue of the clamping in this meandering state, the clamping force of the wire clamping pieces against the large-size wire increases, thereby reliably preventing the electric wire from coming off in the axial and upward directions.

Further, a description will be given of the arrangement of the pair of first wire clamping pieces 23. As shown in FIG. 5, the pair of first wire clamping pieces 23 are projected as planar projecting pieces which respectively project toward an opposing center line from an inner side surface 21*a* and an inner bottom surface 21*b* in the wiring board 21. A slot having a substantially U-shaped cross section with the slot width A is formed by the opposing end faces of the projecting pieces and the inner bottom surface 21*b* of the wiring board 21. Although a description has been given of the arrangement of the first wire clamping pieces 23, the second wire clamping pieces 24 have a similar arrangement, and the first and second wire clamping pieces 25 and 26 of the small-size wire clamping portions 29, which will be described later, also have a similar arrangement.

Next, as shown in FIG. 3, the small-size wire clamping portions 29 which are provided in the same wire accommodating slot 22 adjacent to the above-described large-size wire clamping portions 28 are provided such that the center line of a relatively narrow slot width D between the first wire clamping pieces 25 for a small-size wire and the center line of the wire accommodating slot 22 are aligned with each other.

A slot width E between the pair of second wire clamping pieces 26 for a small-size wire is the same as the slot width D between the pair of the first wire clamping pieces 25, but the center line of the slot width E is offset toward one side (upwardly in the drawing) by a dimension d2 from the center line between the first wire clamping pieces 25.

A diagonal slot width F which is the shortest interval connecting an inner end corner of the first wire clamping piece 25 and an inner end corner of the second wire clamping piece 26 is set to the same dimension as the slot width D between the first wire clamping pieces 25 and the slot width E between the second wire clamping pieces 26. It should be noted that the slot widths D and E and the diagonal slot width F are set to be smaller than the diameter of the small-size wire to be clamped.

Accordingly, as shown in FIG. 6, an end portion of a small-size wire 1*b*, which is inserted in the wire accommodating slot 22 and is linearly inserted and fitted in such a manner as to extend from the pair of second wire clamping pieces 26 to the pair of first wire clamping pieces 25, is clamped at three positions in total involving the slot width D between the first wire clamping pieces 25, the slot width E between the second wire clamping pieces 26 with the center-axis offset d2 with respect to the center line between the first wire clamping pieces 25, and the diagonal slot width F between the inner end corners of the first and second wire clamping pieces 25 and 26. Therefore, the end portion of the small-size wire 1*b* meanders by undergoing compressive deformation from the initial state of the diameter of the small-size wire 1*b*. Hence, by virtue of the clamping in this meandering state, the clamping force of the wire clamping pieces against the small-size wire 1*b* increases, thereby reliably preventing the electric wire from coming off in the axial and upward directions.

As described above, since the large-size wire clamping portions 28 for a large-size wire including the first wire clamping pieces 23 and the second wire clamping pieces 24, and the small-size wire clamping portions 29 for a small-size wire including the first wire clamping pieces 25 and the second wire clamping pieces 26 adjacent to the wire clamping portions 28 are provided in the same wire accommodating slot 22, the large-size wire clamping portions 28 and the small-size wire clamping portions 29 can be selectively used in correspondence with the outside diameter of the covered wire to be used. Accordingly, it is possible to form an appropriate meandering state at either wire clamping portions 28 and 29 in correspondence with at least two kinds of diameters of electric wires, and it is possible to clamp various diameters of covered wires between the wire clamping pieces more reliably.

It should be noted that although, with the electric-wire holding structure in accordance with this embodiment, two sets of wire clamping portions, i.e., the large-size wire clamping portions 28 and the small-size wire clamping portions 29, are provided in such a manner as to be adjacent to each other along the wire accommodating slot 22, a total of three sets of wire clamping portions may be juxtaposed by increasing the number of sets by one. Further, wire clamping portions having an arrangement of two upper and lower stages may be provided by disposing the small-size wire clamping portions 29 on the inner bottom surface side below the large-size wire clamping portions 28 inside the wire accommodating slot 22.

In addition, although the pitch of arrangement between adjacent ones of the wire clamping pieces 23 to 26 is set appropriately in correspondence with the wire diameters, the pitch is generally set to a value substantially equivalent to a maximum diameter of a large-size wire used. Further, the flexural rigidity of the wire clamping pieces 23 to 26 may be adjusted by appropriately providing undercut portions for separating the wire clamping pieces from the inner bottom surface 21*b* inside the wiring board 21 in correspondence with the wire diameter.

Furthermore, since a plurality of wiring boards 21 are laminated, and the wiring board 21 in the uppermost layer is covered with an unillustrated cover housing or the like, the covered wires are prevented from coming off the wire accommodating slot 22 upwardly in that wiring board 21.

Next, referring to FIG. 7, a detailed description will be given of a second embodiment of the electric-wire holding structure in accordance with the invention. An electric-wire holding structure 30 in this embodiment is a holding structure formed in an inside portion of the resin-made wiring board 21 so as to hold an intermediate portion of an electric wire.

Figure 7:
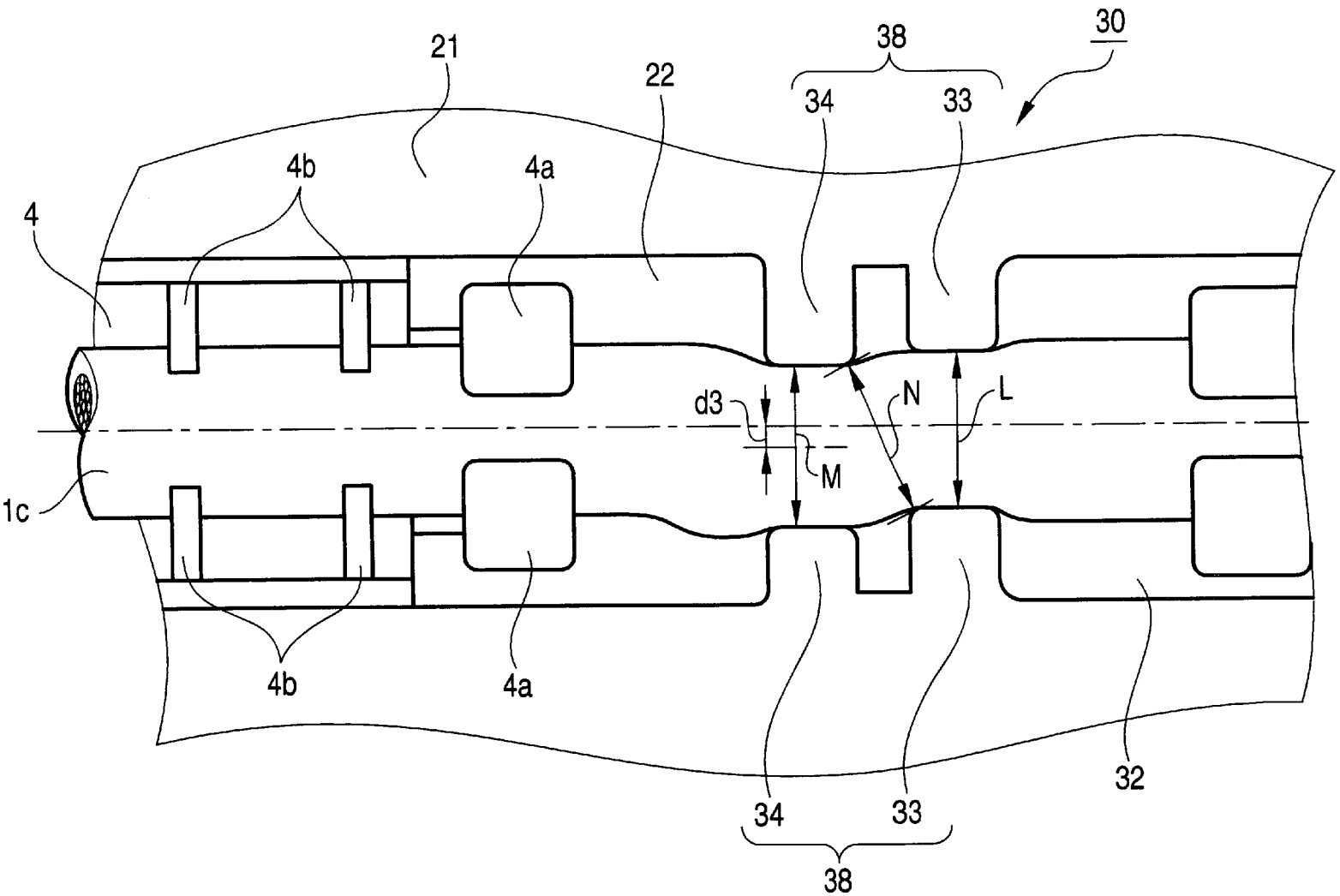
FIG. 7 is a partial plan view of an inside portion of the wiring board illustrating a second embodiment of the electric-wire holding structure in accordance with the invention.
Figure 8:
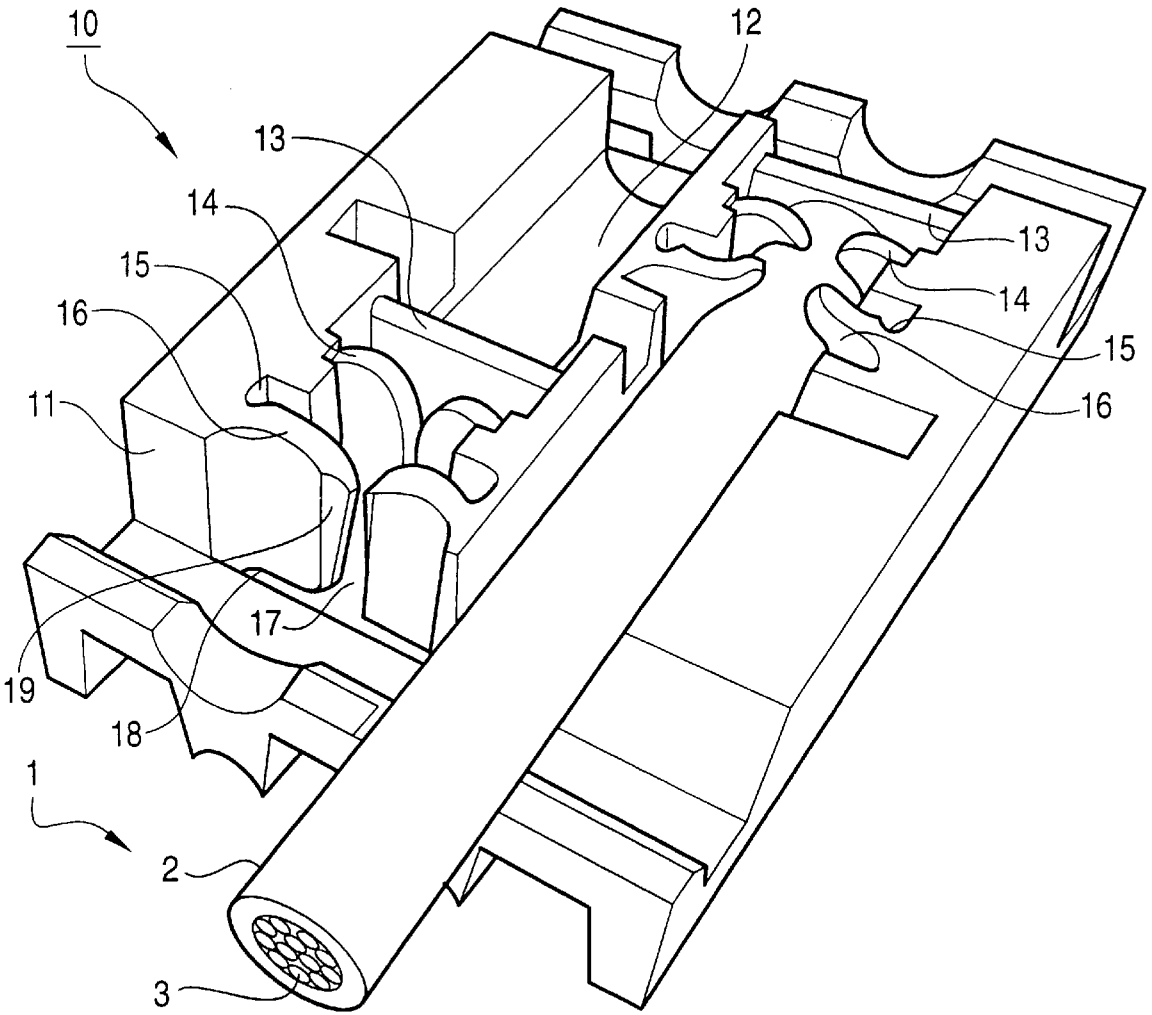
FIG. 8 PRIOR ART
FIG. 8 is a perspective view illustrating an essential portion of a related connector.
Figure 9:
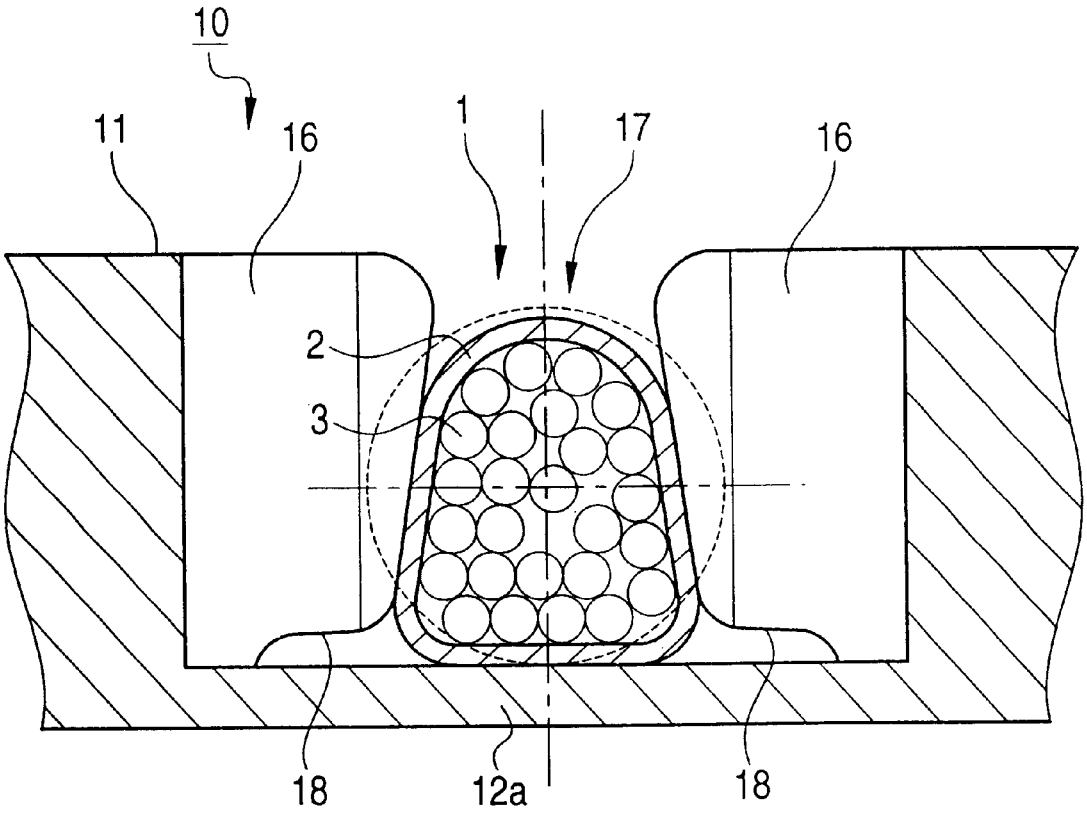
FIG. 9 PRIOR ART
FIG. 9 is a cross-sectional view of FIG. 8.

Namely, as shown in FIG. 7, the electric-wire holding structure in this embodiment is formed in the wire accommodating slot 22 in an inside portion of the wiring board 21 described in the first embodiment, and is provided such that such that the center line of a slot width L between a pair of first wire clamping pieces 33, which form a wire clamping portion 38, and the center line of the wire accommodating slot 22 are aligned with each other.

A slot width M between a pair of second wire clamping pieces 34, which form the other part of the wire clamping portion 38, is the same as the slot width L between the pair of the first wire clamping pieces 33, but the center line of the slot width M is offset toward one side (downwardly in the drawing) by a dimension d3 from the center line between the first wire clamping pieces 33.

Further, a diagonal slot width N which is the shortest interval connecting an inner end corner of the first wire clamping piece 33 and an inner end corner of the second wire clamping piece 34 is set to the same dimension as the slot width L between the first wire clamping pieces 33 and the slot width M between the second wire clamping pieces 34.

It should be noted that the slot widths L and M and the diagonal slot width N are set to be smaller than the diameter of the wire to be clamped. An insulation displacement terminal 4 is fitted at a predetermined position inside the wire accommodating slot 22, and at the same time as a covered wire 1*c* is inserted and fitted in the wire clamping piece 22, the covered wire 1*c* is concurrently press-fitted between pairs of insulation displacing blades 4*b* of the insulation displacement terminal 4. Consequently, the covering of the covered wire 1*c* is cut, and as its internal core is brought into contact with the insulation displacing blades 4*b*, a conducting state is obtained, and the covered wire 1*c* is subsequently crimped by a pair of crimp portions 4*a* located adjacent thereto.

Accordingly, an intermediate portion of the covered wire 1*c*, which is linearly inserted and fitted in such a manner as to extend from the pair of first wire clamping pieces 33 to the pair of second wire clamping pieces 34 in the wire accommodating slot 22, is clamped at three positions in total involving the slot width L between the first wire clamping pieces 33, the slot width M between the second wire clamping pieces 34 with the center-axis offset d3 with respect to the center line between the first wire clamping pieces 33, and the diagonal slot width N between the inner end corners of the first and second wire clamping pieces 33 and 34. Therefore, the intermediate portion of the covered wire 1*c* meanders by undergoing compressive deformation from the initial state of the diameter of the wire. Hence, by virtue of the clamping in this meandering state, the clamping force of the wire clamping pieces against the covered wire 1*c* increases, thereby reliably preventing the electric wire from coming off in the axial and upward directions.

It should be noted that, in combination with the electric-wire holding structure 20 of the above-described first embodiment, the covered wire on the wiring board 21 can be held at a plurality of positions including both ends and intermediate portions of the covered wire, thereby making it possible to hold the covered wire more firmly on the wiring board 21.

Further, with the electric-wire holding structure 30 in this embodiment, although only one set of wire clamping portions 38 is provided, wire clamping portions of a two-stage structure maybe provided by, for example, disposing small-size wire clamping portions on the inner bottom surface side below the wire clamping portions 38 inside the wire accommodating slot 22.

As described above, in accordance with the above-described electric-wire holding structure, the opposing interval between the pair of first wire clamping pieces in the wire accommodating slot and the opposing interval between the pair of second wire clamping pieces located adjacent to the pair of first wire clamping pieces are set to be equal, and the center line between the pair of second wire clamping pieces is offset in one direction from the center line between the pair of second wire clamping pieces. In addition, the shortest interval connecting an inner end corner of the first wire clamping piece and an inner end corner of the second wire clamping piece is set to be equal to the opposing interval between the pair of first wire clamping pieces and the opposing interval between the pair of second wire clamping pieces.

Accordingly, as the wire is inserted between the pairs of first and second wire clamping pieces, the wire can be held by the inner end corner of the first wire clamping piece and the inner end corner of the second wire clamping piece as well. Hence, the wire can be clamped in a meandering state at three positions between the pair of first wire clamping pieces, between the pair of second wire clamping pieces, and between the inner end corners of the first and second wire clamping pieces. Accordingly, electric wires having various wires diameters over a relatively wide range can be held speedily and reliably, and it is possible to reliably prevent the wire from coming off in the axial and upward directions.

In addition, in the above-described electric-wire holding structure, since the pair of large-size wire clamping portions and the pair of small-size wire clamping portions are provided in the same wire accommodating slot in correspondence with outside diameters of the covered wires, it is possible to apply the electric-wire holding structure to electric wires having at least two kinds of wire diameter, and an appropriate meandering state can be formed inside either wire clamping portions depending on the wire diameter. Accordingly, the electric wires of various diameters can be clamped more reliably between the wire clamping pieces. Hence, it is possible to obtain a wiring board, a connector, and the like excelling in versatility.

What is claimed is:

1. An electric-wire holding structure comprising:

a wire accommodating slot for linearly wiring a covered wire; and a pair of first wire clamping pieces and a pair of second wire clamping pieces, each of which are disposed at the wire accommodating slot and are opposite each other with respect to the wire accommodating slot for holding the covered wire;

wherein a center line between the pair of first wire clamping pieces is offset in one direction from a center line between the pair of second wire clamping pieces, wherein a shortest interval connecting an inner end corner of the first wire clamping piece and an inner end comer of the second wire clamping piece is set to be equal to an opposing interval between the pair of first wire clamping pieces and an opposing interval between the pair of second wire clamping pieces, and wherein wire clamping portions respectively including a first wire clamping portion and a second wire clamping portion are separately provided at the wire accommodating slot as a large-size wire clamping portion for large-size wire and as a small-size wire clamping portion for a small-size wire in correspondence with outside diameter of the covered wire, wherein one of the wire clamping portions is formed by the pair of first wire clamping pieces and the pair of second wire clamping pieces.

2. The electric-wire holding structure according to claim 1 further comprising:

an insulation displacement terminal for press-fitting the covered wire provided at the wire accommodating slot.

3. An electric-wire holding structure comprising:

a wire accommodating slot for linearly wiring a covered wire; and a pair of first wire clamping pieces and a pair of second wire clamping pieces, each of which are disposed at the wire accommodating slot and are opposite each other with respect to the wire accommodating slot for holding the covered wire;

wherein a center line between the pair of first wire clamping pieces is offset in one direction from a center line between the pair of second wire clamping pieces, and wherein a shortest interval connecting an inner end corner of the first wire clamping piece and an inner end corner of the second wire clamping piece is set to be equal to an opposing interval between the pair of first wire clamping pieces and an opposing interval between the pair of second wire clamping pieces, further comprising:

an insulation displacement terminal for press-fitting the covered wire provided at the wire accommodating slot.

* * * * *